US010411346B2

(12) United States Patent
Xu et al.

(10) Patent No.: US 10,411,346 B2
(45) Date of Patent: Sep. 10, 2019

(54) PHASE SHIFTING APPARATUS AND ELECTRICALLY ADJUSTABLE ANTENNA

(71) Applicant: Nokia Shanghai Bell Co., Ltd, Shanghai (CN)

(72) Inventors: Chengyu Xu, Shanghai (CN); Zhenhua Li, Shanghai (CN); Zhendong Wang, Shanghai (CN); Chenguang Zhou, Shanghai (CN)

(73) Assignee: NOKIA SHANGHAI BELL CO., LTD., Shanghai (CN)

( * ) Notice: Subject to any disclaimer, the term of this patent is extended or adjusted under 35 U.S.C. 154(b) by 131 days.

(21) Appl. No.: 15/541,539

(22) PCT Filed: Dec. 21, 2015

(86) PCT No.: PCT/CN2015/098024

§ 371 (c)(1),
(2) Date: Jul. 5, 2017

(87) PCT Pub. No.: WO2016/110179

PCT Pub. Date: Jul. 14, 2016

(65) Prior Publication Data

US 2018/0026366 A1 Jan. 25, 2018

(30) Foreign Application Priority Data

Jan. 5, 2015 (CN) ..... 2015 1 0003349

(51) Int. Cl.
*H01Q 1/08* (2006.01)
*H01Q 1/18* (2006.01)
(Continued)

(52) U.S. Cl.
CPC ..... *H01Q 3/32* (2013.01); *H01P 1/18* (2013.01); *H01P 1/184* (2013.01); *H01Q 1/48* (2013.01)

(58) Field of Classification Search
None
See application file for complete search history.

(56) References Cited

U.S. PATENT DOCUMENTS 7,623,008 B2 11/2009 Murano
9,614,281 B2 * 4/2017 Peng ..... H01P 1/184
(Continued)

FOREIGN PATENT DOCUMENTS

CN 201174411 Y 12/2008
CN 101707271 A 5/2010
(Continued)

OTHER PUBLICATIONS

International Search Report for PCT/CN2015/098024 dated Mar. 4, 2016.
(Continued)

*Primary Examiner* — Trinh V Dinh
(74) *Attorney, Agent, or Firm* — Fay Sharpe LLP

(57) ABSTRACT

The present disclosure provides a phase shifting apparatus and an electrically adjustable antenna. The phase shifting apparatus comprises a grounding plate; two bottom substrates respectively arranged on both sides of the grounding plate and coupled to the grounding plate; two top substrates respectively arranged on both sides of the two bottom substrates, wherein each of the top substrates and each of the bottom substrates form a phase shifting unit; a rod coupled to the two top substrates for adjusting a relative sliding movement between the two top substrates and the two bottom substrates so as to simultaneously adjust a phase of the output signal of each phase shifting unit.

12 Claims, 4 Drawing Sheets

(51) Int. Cl.

| | |
|---|---|
| ***H01Q 3/32*** | (2006.01) |
| ***H01P 1/18*** | (2006.01) |
| *H01Q 1/48* | (2006.01) |

(56) References Cited

U.S. PATENT DOCUMENTS

| | | | | |
|---|---|---|---|---|
| 9,825,607 | B2 | 11/2017 | Wu | |
| 2005/0174195 | A1* | 8/2005 | Heiniger | H01P 1/184 333/161 |
| 2005/0219133 | A1* | 10/2005 | Elliot | H01P 1/18 343/757 |
| 2005/0248494 | A1 | 11/2005 | Davies | |
| 2015/0116180 | A1 | 4/2015 | Wu | |

FOREIGN PATENT DOCUMENTS

| | | | |
|---|---|---|---|
| CN | 201838690 | U | 5/2011 |
| CN | 101315997 | B | 7/2012 |
| CN | 102544733 | A | 7/2012 |
| CN | 202423518 | U | 9/2012 |
| CN | 202839907 | U | 3/2013 |
| CN | 103050764 | A | 4/2013 |
| CN | 103117425 | A | 5/2013 |
| CN | 203631728 | U | 6/2014 |
| CN | 104051823 | A | 9/2014 |
| CN | 104103875 | B | 10/2014 |
| CN | 104201440 | A | 12/2014 |
| CN | 204424453 | U | 6/2015 |
| EP | 0984509 | B1 | 5/2004 |
| GB | 2 426 635 | A | 11/2006 |
| JP | 2009-147442 | A | 2/2009 |
| WO | WO 2014/094509 | A1 | 6/2014 |

OTHER PUBLICATIONS

Richo Catalog Editoin 29, Jan. 1, 2010, pp. 46-55.

European Patent Application No. 15876679.0/1205 / 3244479 PCT/CN2015098024, Extended European Search Report, dated Jul. 23, 2018, 11 pages.

PCT Patent Application No. PCT/CN2015/098024, Written Opinion of the International Searching Authority, dated Mar. 4, 2016, 6 pages.

* cited by examiner

PHASE SHIFTING APPARATUS AND ELECTRICALLY ADJUSTABLE ANTENNA

FIELD

The present disclosure generally relates to the field of wireless communications, and more specifically, to a phase shifting apparatus adapted for an electrically adjustable antenna.

BACKGROUND

Electrically adjustable antennas are widely used in wireless transmissions. Apart from radiation units and reflectors, Phase Shifter Network (PSN) is a vital component of the electrically adjustable antenna. A phase shifter is mainly used in the electrically adjustable antenna to adjust a change in phase of the feed network, so as to vary the phase of each radiation unit or a group of radiation units, thereby achieving the purpose of changing a beam tilt angle in a vertical plane or a beam angle in a horizontal plane. Particularly, in the existing phase shifter network, an air strip line is usually adopted to transmit signals, and changes in phase are enabled by placing a movable medium below a specific position of the strip line.

The strip line tends to have the following defects. First, the strip line may be easily deformed due to its long and thin shape, and welding between two strip lines is sometimes required. Secondly, some parts of the PSN are fixed by screws and the metal screws may influence the passive intermodulation (PIM) performance of the PSN. Furthermore, at present the phase shifting unit(s) forming the PSN has complex structure, so it is difficult to assemble and rework. Additionally, PSN sometimes may comprise more phase shifting units. When PSN is used for environmental test, the Antenna Control Unit (ACU) cannot drive the phase shifting apparatus, which causes inconvenience in use of PSN and restricts the application of PSN.

Thus, there is a need for a phase shifting apparatus which has satisfactory PIM performance and is easy to assemble.

SUMMARY

Regarding the above problems, the present disclosure proposes a phase shifting apparatus having satisfactory PIM performance and being easy to assemble and an electrically adjustable antenna with the phase shifting apparatus.

One aspect of the present disclosure provides a phase shifting apparatus comprising: a grounding plate; at least two bottom substrates respectively arranged on both sides of the grounding plate and coupled to the grounding plate; at least two top substrates respectively arranged on both sides of the two bottom substrates, wherein each of the top substrates and each of the bottom substrates form a phase shifting unit; a rod coupled to the two top substrates for adjusting a relative sliding movement between the at least two top substrates and the at least two bottom substrates, so as to simultaneously adjust the phase of the output signal of each phase shifting unit at the same time.

In this way, the above implementation realizes a phase shifting apparatus having at least two phase shifting units and enables simultaneously adjusting phase shifting of the two phase shifting units by opposite phase change trends, which achieves a greater phase difference via a shorter sliding range and reduces the dimension of the phase shifting apparatus.

Preferably, each of the bottom substrates is provided with at least one signal input line and at least one phase-shift signal output line, on a side facing the corresponding top substrate.

Preferably, each of the top substrates is provided with at least one U-shaped line coupled to the at least one signal input line and the at least one phase-shift signal output line, on a side facing the corresponding bottom substrate.

In this way, each phase shifting unit may comprise at least one phase shifter, and each phase shifter is in a one-to-one correspondence with the U-shaped line.

Preferably, the phase shifting apparatus also comprises: a fixing part for fixing the two top substrates in relation to each other, wherein the rod is coupled to the two top substrates via the fixing part.

Preferably, the fixing part comprises: a first fastening piece and a second fastening piece that are capable of being fastened with each other, wherein the top substrates and the bottom substrates are attached when the first fastening piece is fastened to the second fastening piece.

Preferably, the first fastening piece is disposed with at least one rivet and at least one groove, and the second fastening piece is correspondingly disposed with at least one rivet and at least one groove, such that a fixed connection between the first fastening piece and the second fastening piece is formed by the matching between the rivets and the grooves.

Accordingly, screws are not needed in the course of assembling the phase shifting apparatus, which opens the possibility of using a variety of materials.

Preferably, each of the top substrates is provided with at least two through-holes for allowing the rivets of the first and second fastening pieces to pass through; and each of the bottom substrates is provided with at least one slot hole for providing a movement space for the rivets on the first and second fastening piece.

When the top substrates are in motion, the friction force is small, such that an ACU can drive the rod at a low temperature.

Preferably, the phase shifting apparatus also comprises: a plate-joint rivet for fixing the two bottom substrates to the grounding plate by passing the plate joint rivet through a through-hole disposed on each of the bottom substrates and a through-hole disposed on the grounding plate.

Preferably, the bottom substrates and the top substrates are coated with an insulating layer except for a welding position.

Preferably, each of the bottom substrates is provided with one signal input line and three phase-shift signal output lines on a side facing the corresponding top substrate, wherein two of the three phase-shift signal output lines are connected via an external conductor.

Preferably, the fixing part and/or the plate-joint rivet are made of non-metallic material.

Therefore, the phase shifting apparatus does not use or use relatively less metal elements, thereby enhancing the PIM performance of the phase shifting apparatus.

Another aspect of the present disclosure provides an electrically adjustable antenna, comprising a phase shifting apparatus and an antenna control unit coupled to the rod for driving the rod such that the two top substrates slide simultaneously relative to the two bottom substrates.

By employing the technical solution of the present disclosure, screws are not needed in course of assembling the phase shifting apparatus and the metal elements are less used or not used at all, thereby enhancing the PIM performance of the phase shifting apparatus. Furthermore, when the top substrates are in motion, the friction force is small, such that the ACU can drive the rod at a low temperature. Besides, the phase shifting apparatus has fewer parts and is low cost, meanwhile the parts are connected using nonmetallic rivets for ease of assembling and reworking.

BRIEF DESCRIPTION OF THE DRAWINGS

Through the following detailed description of the embodiments of the present disclosure with reference to the accompanying drawings, the present disclosure can be better understood, and other objectives, details, features, and advantages of the present disclosure will become more apparent. In the drawings.

DETAILED DESCRIPTION OF EMBODIMENTS

Preferred embodiments of the present disclosure will be described in more details with reference to the drawings. Although the drawings illustrate the preferred embodiments of the present disclosure, it should be appreciated that the present disclosure can be implemented by various manners and shall not be limited to the implementations disclosed herein. On the contrary, the implementations are provided to make the present disclosure more thorough and complete and to fully convey the scope of the present disclosure to those skilled in the art.

Figure 1:
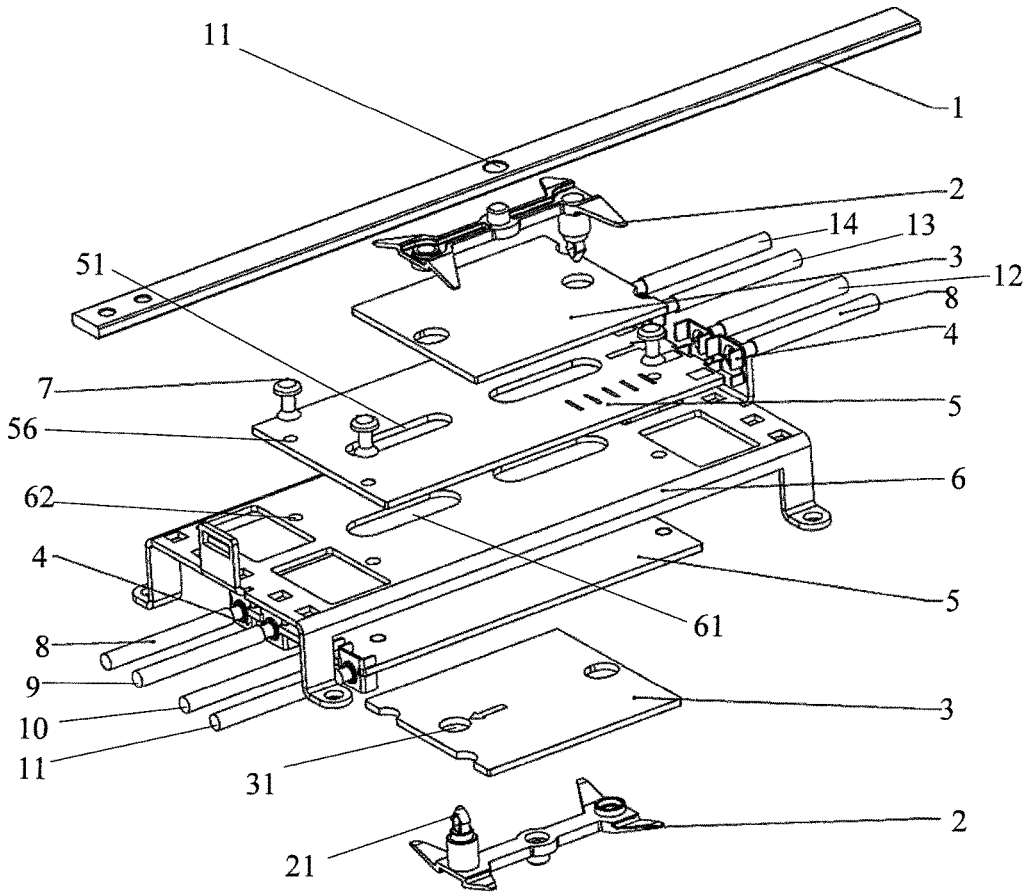
FIG. 1 is an exploded view of the phase shifting apparatus according to embodiments of the present disclosure.

FIG. 1 is an exploded view of the phase shifting apparatus according to embodiments of the present disclosure.

According to FIG. 1, the phase shifting apparatus comprises a rod 1, two fixing parts 2, two top substrates 3, two bottom substrates 5 and a grounding plate 6. A top substrate 3 and a bottom substrate 5 form a phase shifting unit. That is, the phase shifting apparatus comprises two phase shifting units distributed at the upper and lower sides of the grounding plate, and each phase shifting unit may include at least one phase shifter.

Specifically, the two bottom substrate 5 are respectively arranged on both sides of the grounding plate 6 and electrically coupled to the grounding plate 6. The two bottom substrates 5 also comprise signal input lines and phase-shift signal output lines (not shown). The two top substrates 3 are respectively arranged on both sides of the two bottom substrates 5, i.e., the top substrates 3, the bottom substrates 5 and the grounding plate 6 are sequentially disposed. The rod 1 adjusts the relative sliding movement between the top substrates and the bottom substrates, so as to adjust the phase of output signals of each phase shifting unit with an opposite phase change trend at the same time.

Figure 2:
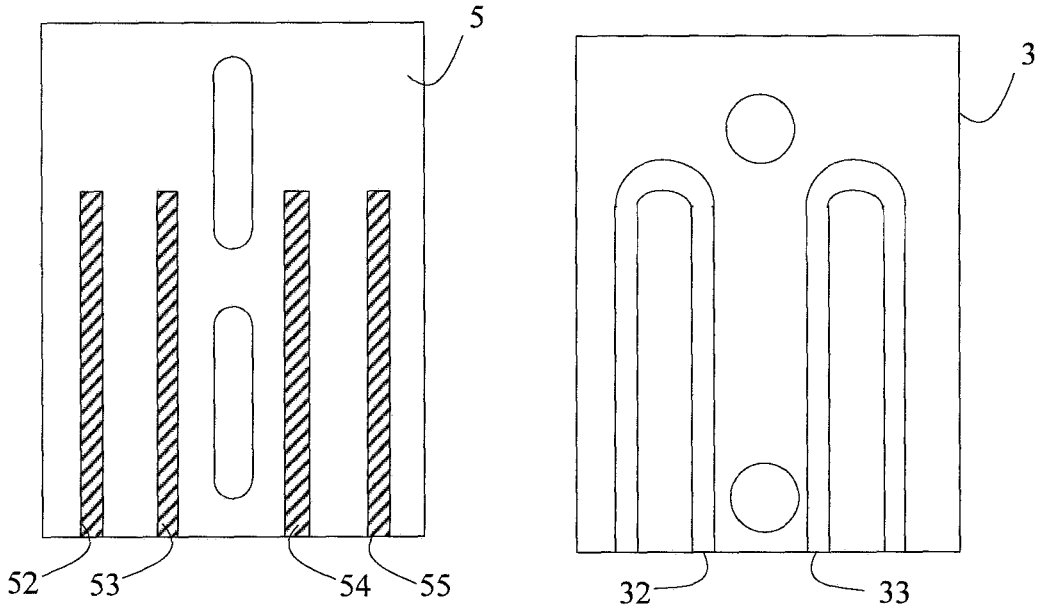
FIG. 2 is a brief schematic diagram of a bottom substrate and a top substrate according to embodiments of the present disclosure.

FIG. 2 is a brief schematic diagram of bottom substrates and top substrates according to embodiments of the present disclosure.

The bottom substrates 5 are provided, on the side facing the top substrates 3, with at least one signal input line and at least one phase-shift signal output line, e.g., one signal input line 52 and three phase-shift signal output lines 53-55, respectively. The top substrates 3 are provided, on the side facing the bottom substrates 5, with at least one U-shaped line, e.g., two U-shaped lines 32 and 33. When a bottom substrate approaches, or even attaches a top substrate, the signals between the two substrates can be transmitted through coupling even if they are coated with the insulating layer. In this way, the two U-shaped lines in FIG. 2 implement two phase shifters, i.e., the phase shifting unit comprise two phase shifters. It will be appreciated that FIG. 2 does not illustrate all details of the bottom substrates and the top substrates and only shows the parts associated with signal coupling.

Preferably, apart from the welding position, the bottom substrate 5 and the top substrate 3 are coated with the insulating layer, e.g., liquid photoimagable solder mask (also referred to green oil).

Now continue to refer to FIG. 1. In this embodiment, the fixing parts 2 fix the two top substrates 3 disposed on both sides of the grounding plate 6 in relation to each other. The fixing parts 2 are further coupled to the rod 1, so as to drive the top substrates 3 disposed on both sides of the grounding plate 6 to move in the same direction as the rod 1 does when the rod 1 moves side to side.

Preferably, the fixing parts 2 comprise a first fastening piece and a second fastening piece which may be fastened to each other when they coordinate. When the first fastening piece and second fastening piece are fastened, the top substrates attach the bottom substrates, or a small gap is present therebetween. Specifically, the first fastening piece is provided with at least one rivet 21 and at least a groove, and the second fastening piece is correspondingly provided with at least one rivet 21 and at least one groove, such that the first fastening piece and the second fastening piece can form a fixed connection by the matching between the rivet and the groove. Accordingly, the top substrate 3 is arranged thereon with at least two through-holes 31 for securing, through which the rivets 21 on the first fastening piece and second fastening piece pass. The bottom substrate is also provided thereon with at least one slot hole, e.g., two slot holes 51 for providing motion spaces for the rivets 21 on the first fastening piece and second fastening piece. That is, the rivet 21 on the first fastening piece may first pass through the through-hole 31, the slot hole 51 and the slot hole 61 and then go through the slot hole 51 and the through-hole 31 on the other side to finally be inserted into the groove on the second fastening piece, thereby forming a fixed connection. When the rod 1 moves side to side, the top substrates 3 on both sides of the ground plate 6 move in the same direction. Because the rivets are within the slot holes 51 and 61, the friction force in motion is small.

To maintain the fixed connection between the bottom substrates 5 and the grounding plate 6 and avoid relative displacement, the phase shifting apparatus also comprises plate-joint rivet(s) 7, which fixes the two bottom substrates and the grounding plate with each other via the through-holes 56 disposed on the two bottom substrates 5 and the through-hole 62 on the grounding plate.

Figure 3:
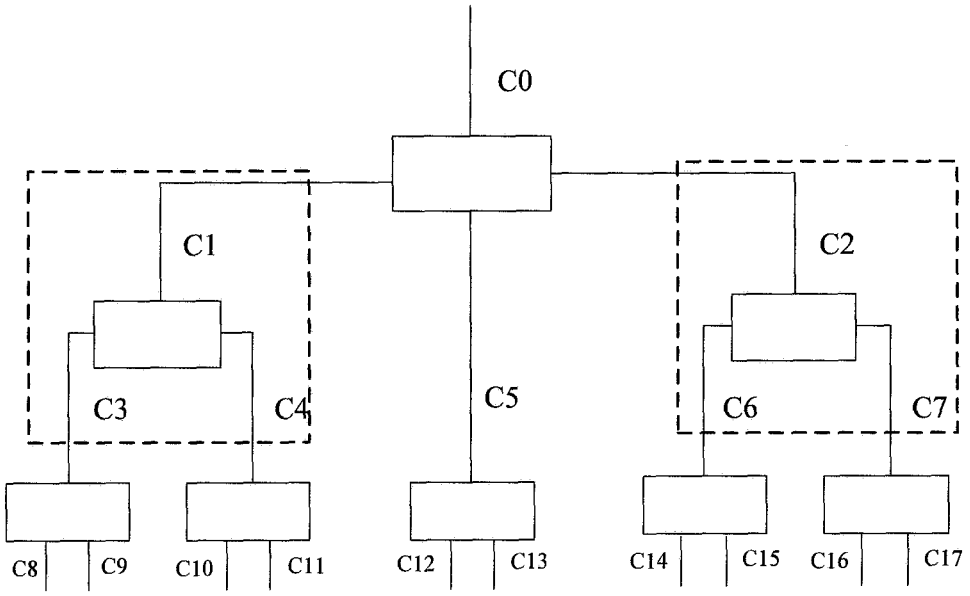
FIG. 3 is a schematic diagram of phase-shift signals of an antenna according to embodiments of the present disclosure.

FIG. 3 is a schematic diagram of phase-shift signals of an antenna according to embodiments of the present disclosure.

In FIG. 3, C0 is an input cable; C1 and C2 are cables between a power distributer and phase shifters; C3-C4 and C6-C7 are cables from the phase shifters to power distributers; C5 is a cable between two power distributers, and C8-C17 are required phase-shift signals. The phase shifting apparatus in this embodiment is the parts in the dotted box. In this case, the above signal input lines 52 disposed on the two bottom substrates correspond to C1 and C2. Likewise, the phase shifting output lines 53-55 disposed on the two bottom substrates correspond to C3-C4 and C6-C7.

When the phase shifting apparatus is used in an antenna, it is required to input signals to the phase shifting apparatus and receive phase-shift signals from the phase shifting apparatus. Accordingly, as shown in FIG. 1, the cables 8-11 are respectively coupled to one signal input line 52 and three phase-shift signal output lines 53-55 provided on the bottom substrate 5 via a coupling block 4. Correspondingly, the cables 8 and 12-14 are respectively coupled to the signal input line and three phase-shift signal output lines on the other bottom substrate 5.

Furthermore, the cables 9 and 10 are connected and cables 12 and 13 are connected, which respectively form the corresponding C4 and C6.

When the rod 1 drives the upper and lower top substrates to move in the same direction, it is obvious that the transmission paths of the signals between the upper and lower top substrates and the two bottom substrates change, i.e., one gets greater while the other becomes smaller, such that the phase difference between C3 and C7 is widened. Therefore, the present embodiment allows the top substrates to only move a short distance so as to achieve the effects of changing the phase difference by the arrangement of the two layers of substrates, i.e., an upper layer and a lower layer. Therefore, the phase shifting apparatus can be designed with small dimension for lower costs.

Preferably, the fixing parts 2 and/or the plate-joint rivets 7 are made of nonmetallic materials, to improve PIM performance of the phase shifting apparatus. The nonmetallic materials can be plastic, rubber and so on.

Figure 4A:
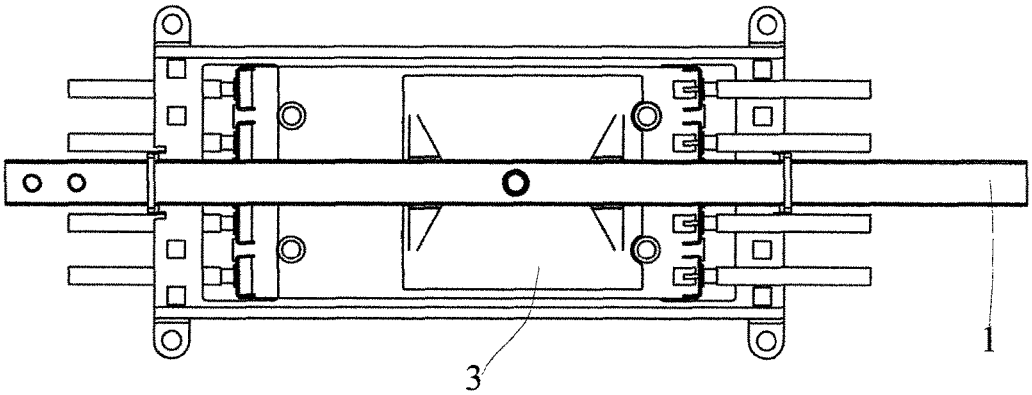
FIG. 4*a* is a schematic diagram of the assembled phase shifting apparatus prior to sliding according to embodiments of the present disclosure.
Figure 4B:
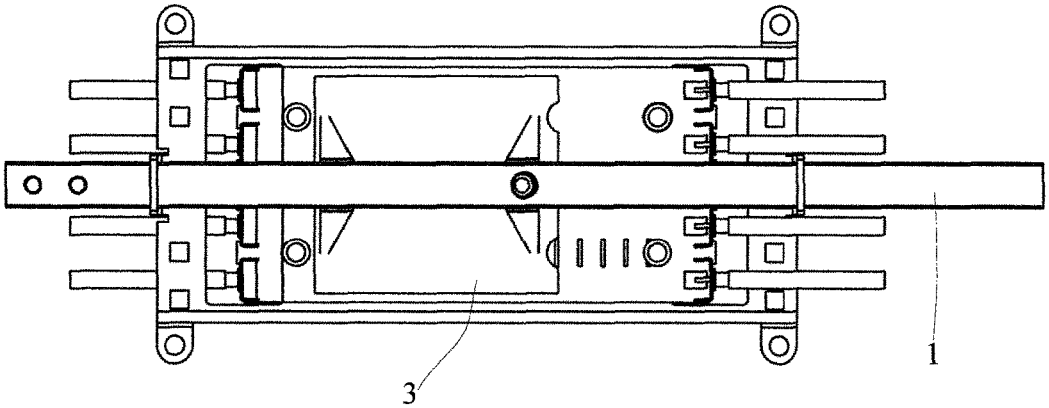
FIG. 4*b* is a schematic diagram of the assembled phase shifting apparatus after sliding according to embodiments of the present disclosure.

FIG. 4*a* is a schematic diagram of the status of the assembled phase shifting apparatus before sliding according to embodiments of the present disclosure, and FIG. 4*b* shows a schematic diagram of the status of the assembled phase shifting apparatus after sliding according to embodiments of the present disclosure.

Apparently, the lengths of the transmission paths of the signals can be changed when the rod 1 drives the top substrates 3 to move, such that the phase shifting apparatus enables a greater phase difference at its left and right sides by a slide of a short distance.

The present disclosure also provides an electrically adjustable antenna, comprising the phase shifting apparatus, as described above, and an ACU, wherein the ACU is coupled to the rod 1 for driving the rod 1, such that the two top substrates can simultaneously slide relative to the two bottom substrates. In this way, a greater phase difference is achieved by a shorter sliding range.

Figure 5A:
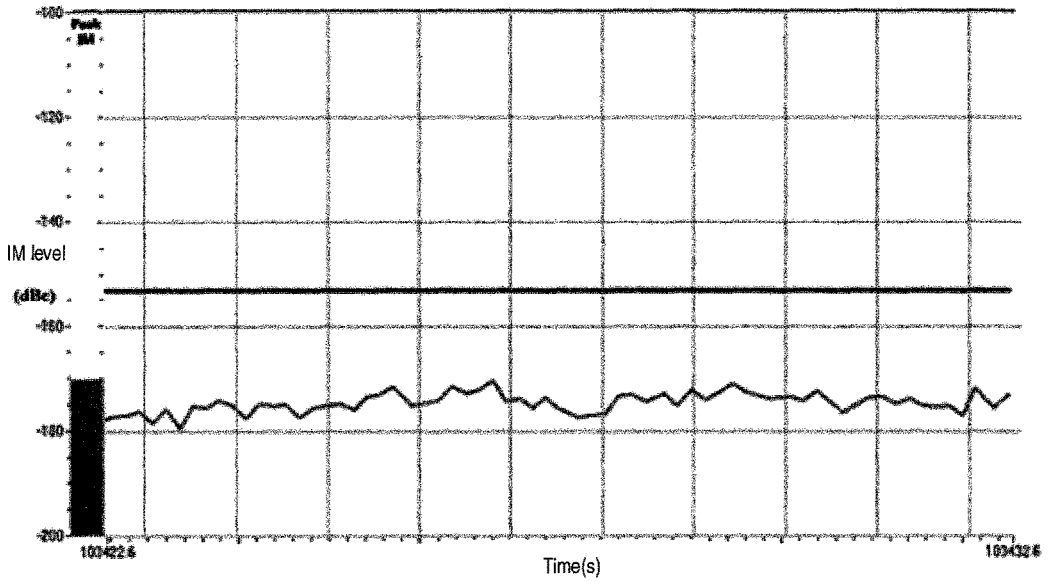
FIG. 5*a* is a simulation diagram of passive intermodulation of the phase shifting apparatus at a carrier frequency of 1900 MHz according to embodiments of the present disclosure.
Figure 5B:
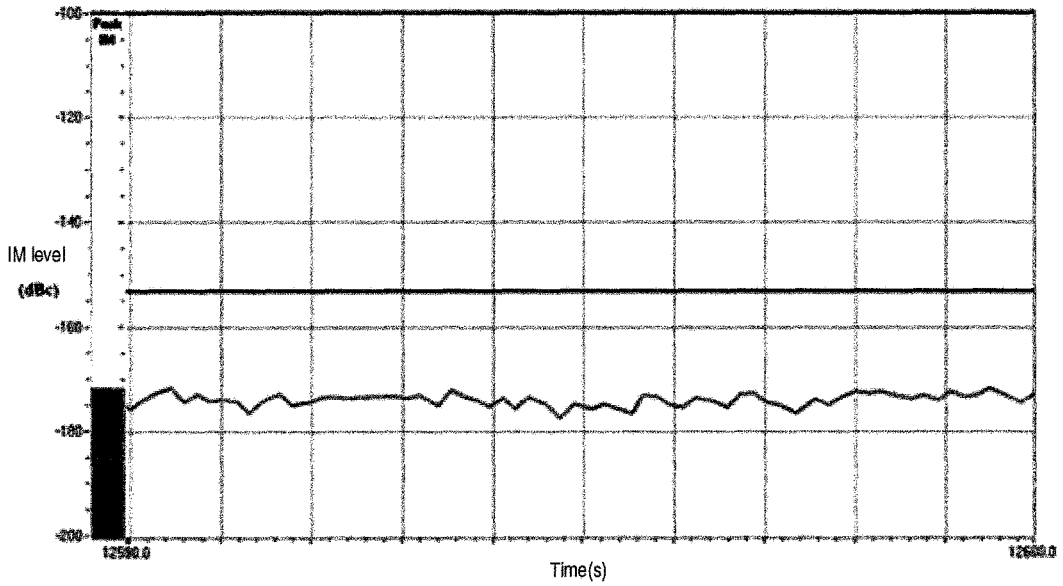
FIG. 5*b* a simulation diagram of passive intermodulation of the phase shifting apparatus at a carrier frequency of 2600 MHz according to embodiments of the present disclosure.

FIG. 5*a* is a simulation diagram of passive intermodulation of the phase shifting apparatus at a carrier frequency of 1900 MHz according to embodiments of the present disclosure, and FIG. 5*b* a simulation diagram of passive intermodulation of the phase shifting apparatus at a carrier frequency of 2600 MHz according to embodiments of the present disclosure.

As the intermodulation distortion of passive devices is related to the magnitude of the carrier frequency power, the expression of relative value, i.e., the ratio of the passive intermodulation value to the carrier frequency in dBc, may better reflect the stability of the passive intermodulation of the phase shifting apparatus.

When the transmit power is 20 W, it can be observed from FIG. 5*a* that the worst scenario for passive intermodulation of the phase shifting apparatus is −173 dBc at the carrier frequency of 1900 MHz. Besides, it can be seen from FIG. 5*b* that the worst scenario for passive intermodulation of the phase shifting apparatus is −172 dBc at the carrier frequency of 2600 MHz.

Therefore, the phase shifting apparatus of the present disclosure has stable PIM performance.

To sum up, the phase shifting apparatus of the present disclosure comprises two phase shifting units. It enables phase shifting by simultaneously adjusting the two phase shifting units with opposite phase change trends, which realizes a greater phase difference via shorter sliding range and reduces the dimension of the phase shifting apparatus. Additionally, screws are not needed in course of assembling the phase shifting apparatus, which avoids the impact on the PIM performance by the use of metal elements in the phase shifting apparatus. Besides, when the top substrates move, the friction force is smaller, so that an ACU can drive the rod at a low temperature. The phase shifting apparatus has fewer parts and is low cost, meanwhile the parts are connected using nonmetallic rivets for ease of assembling and reworking.

Those skilled in the art can understand that the above state is only exemplary and should not limit the scope of the present disclosure. Those skilled in the art can accommodate the described functions to each particular application. However, such implementation strategy should not be interpreted as deviating from the protection scope of the present disclosure.

We claim:

1. A phase shifting apparatus, wherein comprising:

a grounding plate;

at least two bottom substrates arranged on respective sides of the grounding plate and coupled to the grounding plate;

at least two top substrates arranged on respective sides of the two bottom substrates, wherein a first one of the top substrates and a first one of the bottom substrates form a first phase shifting unit, wherein a second one of the top substrates and a second one of the bottom substrates form a second phase shifting unit; and a rod coupled to the two top substrates, wherein the rod is configured to adjust a relative sliding movement between the at least two top substrates and the at least two bottom substrates and to simultaneously adjust a phase of an output signal of each phase shifting unit.

2. The phase shifting apparatus according to claim 1, wherein, each of the bottom substrates is provided with at least one signal input line and at least one phase-shift signal output line, on a side facing the corresponding top substrate.

3. The phase shifting apparatus according to claim 2, wherein, each of the top substrates is provided with at least one U-shaped line coupled to the at least one signal input line and the at least one phase-shift signal output line, on a side facing the corresponding bottom substrate.

4. The phase shifting apparatus according to claim 1, wherein the phase shifting apparatus further comprises:

a fixing part for fixing the two top substrates in relation to each other, wherein the rod is coupled to the two top substrates via the fixing part.

5. The phase shifting apparatus according to claim 4, wherein the fixing part comprises:

a first fastening piece and a second fastening piece that are configured to be fastened with each other, wherein the top substrates and the bottom substrates are attached when the first fastening piece is fastened to the second fastening piece.

6. The phase shifting apparatus according to claim 5, wherein, the first fastening piece is disposed with at least one rivet and at least one groove, and the second fastening piece is correspondingly disposed with at least one rivet and at least one groove, such that a fixed connection between the first fastening piece and the second fastening piece is formed by the matching between the rivets and the grooves.

7. The phase shifting apparatus according to claim 6, wherein, each of the top substrates is provided with at least two through-holes for allowing the rivets of the first and second fastening pieces to pass through; and each of the bottom substrates is provided with at least one slot hole for providing a movement space for the rivets on the first and second fastening piece.

8. The phase shifting apparatus according to claim 1, wherein, further comprising:

a plate-joint rivet for fixing the two bottom substrates to the grounding plate by passing the plate-joint rivet through a through-hole disposed on each of the bottom substrates and a through-hole disposed on the grounding plate.

9. The phase shifting apparatus according to claim 1, wherein, the bottom substrates and the top substrates are coated with an insulating layer except for a welding position.

10. The phase shifting apparatus according to claim 1, wherein, each of the bottom substrates is provided with one signal input line and three phase-shift signal output lines on a side facing the corresponding top substrate, wherein two of the three phase-shift signal output lines are connected via an external conductor.

11. The phase shifting apparatus according to claim 1, wherein, the fixing part and/or the plate-joint rivet are made of non-metallic material.

12. An electrically adjustable antenna, comprising:

the phase shifting apparatus according to claim 1; and an antenna control unit coupled to the rod, wherein the antenna control unit is configured to drive the rod, such that the two top substrates slide simultaneously relative to the two bottom substrates.

* * * * *